United States Patent [19]

Moser et al.

[11] Patent Number: 4,906,291

[45] Date of Patent: Mar. 6, 1990

[54] METHOD FOR MANUFACTURING MELT MATERIALS OF COPPER, CHROMIUM, AND AT LEAST ONE READILY EVAPORABLE COMPONENT USING A FUSIBLE ELECTRODE

[75] Inventors: Thomas Moser, Schnaittach; Joachim Grosse, Erlangen; Horst Kippenberg, Herzogenaurach; Ruediger Hess, Berlin; Reiner Mueller, Steinbach; Norbert Proelss, Wendelstein, all of Fed. Rep. of Germany

[73] Assignee: Siemens Aktiengesellschaft, Berlin & Munich, Fed. Rep. of Germany

[21] Appl. No.: 264,327

[22] Filed: Oct. 28, 1988

[30] Foreign Application Priority Data

Nov. 2, 1987 [DE] Fed. Rep. of Germany ..... 3737135

[51] Int. Cl.[4] ..... C22B 4/00

[52] U.S. Cl. ..... 75/10.23; 75/10.1

[58] Field of Search ..... 75/10.1, 10.23; 164/495; 219/146.22, 146.23

[56] References Cited

U.S. PATENT DOCUMENTS

| | | | |
|---|---|---|---|
| 3,596,027 | 7/1971 | Okutomi et al. | 200/144 B |
| 3,933,474 | 1/1976 | Ham | 75/10.23 |
| 4,088,475 | 5/1978 | Taylor et al. | 75/76 |
| 4,481,030 | 11/1984 | Schmidt | 75/10.23 |

FOREIGN PATENT DOCUMENTS 0073585 8/1982 European Pat. Off. .

OTHER PUBLICATIONS

F. J. Zanner and L. A. Bertram, "Behavior of Sustained High—Current Arcs on Molten Alloy Electrodes During Vacuum Consumable Arc Remelting", IEEE Transactions on Plasma Science, vol. PS-11, No. 3, pp. 223-232, Sep. (1983).

*Primary Examiner*—Peter D. Rosenberg
*Attorney, Agent, or Firm*—Kenyon & Kenyon

[57] ABSTRACT

A method for manufacturing melt materials of copper, chromium, and at least one readily evaporable component as well as a fusible electrode for using this method is disclosed.

More specifically, an arc melting method is used for the manufacture of melt materials based on copper and chromium in which the electrode material melting off a fusible electrode of given resultant composition is collected in a water-cooled permanent mold for the purpose of cooling down without macroscopic separation of copper and chromium.

A fusible electrode for use in this method is also provided. This fusible electrode partially consists of a solid alloy of copper with the readily evaporable component.

25 Claims, 1 Drawing Sheet

METHOD FOR MANUFACTURING MELT MATERIALS OF COPPER, CHROMIUM, AND AT LEAST ONE READILY EVAPORABLE COMPONENT USING A FUSIBLE ELECTRODE

TECHNICAL FIELD

This invention relates to a method for the manufacture of melt materials of copper, chromium, and at least one readily evaporable component. The invention also provides a fusible electrode for use in the method.

BACKGROUND OF THE INVENTION

A method for manufacturing melt materials of copper, chromium and at least one readily evaporable component has been described in H. Hassler et al. (Eur. Pat. No. 115,292). Materials manufactured in accordance with this method were first used as contact material for vacuum medium voltage power switches with switch-off current above 10 kA. R. Mueller et al. (Eur. Pat. No. 172,411) also discloses using materials manufactured in accordance with this method as contact material for vacuum contactors and teaches incorporating in these materials additions of at least one of the metals, tellurium, antimony, bismuth, or tin, as well as their alloys, to reduce the welding load. The introduction of the additives into the contact pieces fabricated according to the previously known method takes place by subsequent alloying in or diffusing in. However, this is comparatively cumbersome and expensive.

Tellurium, selenium, antimony, and bismuth have all proven to be suitable addition components for copper-chromium contact materials for welding load reduction. The above-mentioned elements are, however, characterized by a high vapor pressure so that additions of these elements evaporate readily in arc melting methods. It has also been previously shown that the direct alloying in of these elemental additions in the arc melting of copper-chromium is not possible since these additions evaporate under the influence of the arc due to their high vapor pressure. This leads to the formation of pores in the melt block. This is particularly true if the elemental additions are mixed in the electrode as fine-particled powder. Tellurium, selenium, or antimony form, in combination with cooper, intermetallic compounds which have a reduced vapor pressure and, accordingly, a reduced tendency to evaporate when compared to the components tellurium, selenium, or antimony used in isolation.

However, pore formation also occurs if the elemental additions are not mixed in as elementary tellurium, selenium, or antimony but are instead mixed in as the intermetallic compounds $Cu_2Te$, $Cu_2Se$, or $Cu_3Sb$ in a powder form. The discovery of this phenomenon can be traced back to the charging of fine-particled $Cu_2Te$ or $Cu_2Se$ or $Cu_3Sb$ powder with gas. To this day, however, a fine-particled powder is considered absolutely essential for a homogeneous distribution.

Since tellurium, selenium, antimony, or their intermetallic Cu compounds cannot be directly alloyed in as described above during the melt process, tellurium as discussed in Eur. Pat. No. 172,411, has traditionally been introduced following the arc melting and possibly after the corresponding shaping of the CuCr block through, for example, extrusion in a separate finishing step. In this process an additional method step is required which thereby increases the cost of the manufacturing method.

SUMMARY OF INVENTION

It is an object of the present invention to provide a method for the manufacture of melt materials of copper, chromium, and at least one evaporable component which comprises melting a fusible electrode with an electrical arc to produce melted electrode material. The fusible electrode used in this method at least in part comprises a solid alloy of copper with a readily evaporable component. The melted electrode material is cooled with a water-cooled permanent mold means to prevent macroscopic separation of copper and chromium.

It is another object of the present invention to provide a fusible electrode for use in this method which comprises copper, chromium, and a readily evaporable component selected from the group consisting of tellurium, selenium, antimony, and mixtures thereof. The readily evaporable component is at least partially alloyed in the copper as an intermetallic compound and the copper-tellurium-, copper-selenium-, or copper-antinomy-alloys are present in the electrode as solid parts. The concentration of the readily evaporable component in the alloy is higher than in the resultant composition of the melt material and the readily evaporable component remains bound in the melt material during the melting process.

The use of these fusible electrodes permits the direct introduction of the readily evaporable additions in arc melted copper chromium alloys during the melting process. Therefore, pore-free CuCrTe, CuCrSe, and CuCrSb melt blocks may be manufactured. In particular, all effects leading to the formation of pores when tellurium is introduced in the melting process are avoided. For example, solid bars of a CuTe alloy such as CuTeO.6 are introduced into an electrode tube which are then enveloped with CuCr powder.

It has been found that the vapor pressure of, for example, solid CuTeO.6 is substantially lower than that of a pure tellurium or copper telluride. For that reason, no evaporation of the Te component takes place upon arc-melting, whereby the tellurium remains bound in the melt material. According to the present invention, the charging with gas of the tellurium-containing powder is additionally omitted in the manufacturing method. Thus, for the first time, pore-free arc melted materials of CuCrTe, CuCrSe, CuCrSb, CuCrTeSe, or CuCrTeSb can be produced without additional fabrication steps.

Further details and advantages of the invention are evident from the following description taken by reference to the drawings. The Figures are drawn on a scale of 1:2 so that the particular size ratios are comparable. Identical parts in each of the Figures have identical reference numbers.

DETAILED DESCRIPTION OF THE INVENTION

Figure 1:
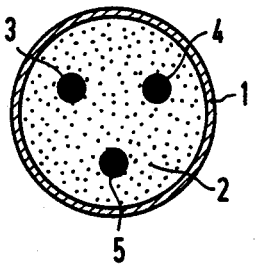
FIG. 1 shows a cross sectional view of a fusible electrode of the present invention.
Figure 2:
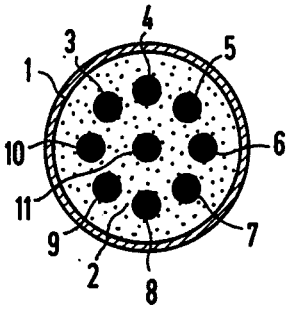
FIG. 2 shows a cross sectional view of another fusible electrode of the present invention.
Figure 3:
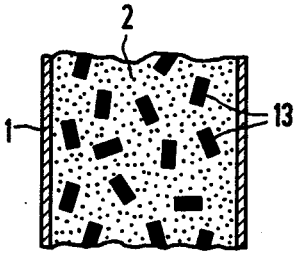
FIG. 3 shows a longitudinal sectional view of another fusible electrode of the present invention.

A preferred embodiment shown in FIGS. 1 to 3 of a fusible electrode of the present invention includes a copper pipe 1 which is filled by a CuCr powder mixture 2 of low-gas quality of given particle sized distribution. The copper pipe 1 has cross sectional dimensions of, for example, 70×2 mm. OFHC (oxygen free high conductivity) or SF (sauerstoffrei=oxygen-free) materials maybe used in constructing the copper pipe 1.

In FIG. 1, three solid rods 3 to 5 having a diameter of 10 mm of an alloy, of, for example, CuTeO.6 are embedded in the CuCr powder mixture 2. This material is known according to DIN 17 666 under the material number 21546 and has a tellurium content of 0.4 to 0.7 by weight. Correspondingly, in FIG. 2 nine rods 3–11 with a diameter of 10 mm of an alloy of, for example, CuTeO.6 are embedded in the CuCr powder mixture 2.

It has been shown that with the copper pipe of the geometry given in FIG. 1 or 2, the number of rods can be varied between 1 and 10. The diameter of these rods can also be varied from 1 mm to 10 mm. The tellerium or selenium or antimony content of the individual rods determine the concentration of the particular element in the finished material. The profile of the individual rods is of no significance. The rods can have, for example, round, square or tubular shapes.

Furthermore, the concentration of copper and chromium in the CuCr powder mixture can be varied. Powders ranging from about 25% by weight Cr up to pure Cr powder are preferred.

In FIG. 3, a multitude of individual sections 13 of rods or profiles with given cross section CuTeO.6 material are approximately uniformly embedded in the CuCr powder mixture 2 contained in the copper pipe 1. Using such a diffusable electrode likewise results in binding the readily evaporable component in the melt material.

Figure 4:
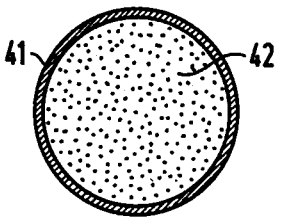
FIG. 4 shows a cross sectional view of another fusible electrode of the present invention.

In FIG. 4 an outer pipe 41 with the cross sectional dimensions 70×2 mm consists of CuTe material. A CuCr powder mixture 42 is introduced into the pipe 41. The tellurium also remains bound during melt-down in a fusible electrode structured in this fashion and alloys into the melt material.

Specifically, in a fusible electrode according to FIG. 1 or FIG. 2, the composition of the CuCrTe, CuCrSe, or the CuCrSb melt material to be manufactured with given rod diameters is determined by the number of rods, on the one hand, and by the tellurium or selenium or antimony content in the rods, on the other hand. From the point of view of manufacturing technology, it is theoretically possible that solid rods of copper-tellurium alloys can have a tellurium content of up to 8.2% weight content. With a maximum number of 10 rods of CuTe8.2 having a diameter of 10 mm, in a copper pipe of diameter 70×2 mm, this would lead to a CuCr50Te4.1 material if the pipe also consists of the CuTe pre-alloy. Manufacturing solid alloys with higher tellurium content is prevented by the separation which occurs in the liquid state in the 2-substance system CuTe. This limitation also applies for copper selenium alloys since in this system CuSe separation in the liquid state occurs above 2.2% by weight. Consequently, given a maximum rod number of 10, a CuCr50Se1.1 material can be manufactured.

A series of examples specific for the manufacture of CuCrTe melt material by using a fusible electrode according to FIG. 1 or FIG. 2 is given in Table I. Table I summarizes how the concentration of the melt material can be influenced by the number of rods, the tellurium content, and by the composition of the copper-chromium powder mixture. In all examples, a tube electrode with diameter 70×2 mm is assumed. Use of tube electrodes of greater or lesser diameters, for example, between 50 and 100 mm is also possible. The tellurium content of the melt material is likewise determined by the number and diameter of the CuTe rods or the diameter in thickness of the CuTe pipe. Thus with Cu pipes of a diameter 52×2 mm and having rods of CuTe0.6 with 10 mm diameter, a tellurium content in the melt material of 0.1% by weight is obtained.

TABLE I

EXAMPLES FOR CuCrTe MELT MATERIALS GIVEN DIFFERENT ROD NUMBERS (Electrode structure:Cu pipe 70 × 2 mm)

| Rod No. | Conc. of Alloy (percent by w.) | Diam. (mm) | Powder Mixture (percent by w.) | Conc. of Melt Material (percent by w.) |
|---|---|---|---|---|
| 2 | CuTeO.6 | 10 | CuCr72 | CuCr50TeO.05 |
| 3 | CuTeO.6 | 10 | CuCr75 | CuCr50TeO.07 |
| 4 | CuTeO.6 | 10 | CuCr79 | CuCr50TeO.10 |
| . | . | . | . | . |
| . | . | . | . | . |
| . | . | . | . | . |
| 10 | CuTe0.6 | 10 | Cr | CuCr50TeO.25 |
| 10 | CuTe8.2 | 10 | Cr | CuCr50Te2.70 |

Corresponding calculations for the proper proportioning of the tube electrode and the necessary number of rods can also be carried out for CuCrSe, CuCrSb, CuCrTeSe, and CuCrTeSb melt materials.

The arc melting with the above described fusible electrodes takes place in the manner described in Eur. Pat. Appl. 115,292 in a protective gas atmosphere. For example, 100 mbar helium or argon have proven to be suitable.

Although the present invention is described herein with some specificity, persons of skill in the art will recognize modifications and variations that are within the spirit of the invention as described. It is intended that such modifications and variations also be encompassed by the following claims.

We claim:

1. A method for manufacturing melt material of copper, chromium and at least one further component selected from the group consisting of tellurium, selenium, antimony or mixtures thereof, which comprises:

(a) melting a fusible electrode with an electrical arc to produce melted material, said fusible electrode consisting of copper, chromium and at least in part an intermetallic compound with tellurium, selenium or antimony as a solid alloy with copper; and (b) cooling said melted material with a water-cooled permanent mold means to prevent macroscopic separation of copper and chromium;

wherein tellurium, selenium, or antimony remains bound in said melt material during the melting process.

2. The method according to claim 1 wherein the concentration of said tellurium, selenium, or antimony in said alloy is higher than in the resultant composition of said melt material.

3. A fusible electrode suitable for use in a method for manufacturing melt material which comprises copper, chromium, and a further component selected from the group consisting of tellurium, selenium, antimony, or mixtures thereof, wherein said tellurium, selenium, or antimony is at least partially alloyed in the copper as an intermetallic compound, with the copper-tellurium-, copper-selenium-, or copperantimony-alloy being present in the electrode as solid parts.

4. The fusible electrode according to claim 3 wherein the concentration of said tellurium, selenium, or antimony in said alloy is higher than in the resultant composition of said melt material.

5. The fusible electrode according to claim 3 wherein said tellurium, selenium, or antibody remains bound in said melt material during the melting process.

6. The fusible electrode according to claim 3 wherein said fusible electrode contains solid shaped parts.

7. The fusible electrode according to claim 6 wherein the shape of said solid parts is round, square, or tubular.

8. The fusible electrode according to claim 3 wherein the structure of said fusible electrode consists of a copper pipe in which a copper chromium powder mixture and said solid parts of copper-tellurium, copper-selenium, or copper-antimony alloy are embedded.

9. The fusible electrode according to claim 8 wherein said copper pipe consists of low-oxygen copper.

10. The fusible electrode according to claim 9 wherein said copper pipe consists of oxygen free high conductive copper.

11. The fusible electrode according to claim 9 wherein said copper pipe consists of oxygen-free copper.

12. The fusible electrode according to claim 8 wherein said solid parts are continuous rods which are embedded parallel and at a distance from each other in the CuCr powder mixture.

13. The fusible electrode according to claim 12 wherein said electrode structure consists of a pipe having cross sectional dimensions of 70×2 mm.

14. The fusible electrode according to claim 13 wherein 1 to 10 rods of a copper-tellurium, copper-selenium, or copper-antimony alloy of 10 mm diameter are embedded in said pipe.

15. The fusible electrode according to claim 14 wherein said rods are distributed symmetrically.

16. The fusible electrode according to claim 6 wherein said solid parts are uniformly distributed as sections in the CuCr powder mixture.

17. The fusible electrode according to claim 6 wherein said electrode structure consists of a pipe having a copper-tellurium, copper-selenium or copper-antimony alloy as an outer shell within which a copper-chromium powder mixture is embedded.

18. The fusible electrode according to claim 3 wherein said further component is tellurium and wherein a copper-chromium or pure chromium powder is embedded in said pipe.

19. The fusible electrode according to claim 18 wherein the Te in said solid part comprises up to 8.2% by weight, thus producing a CuCrTe material with a tellurium content of up to about 4.1% by weight.

20. The fusible electrode according to claim 3 wherein said further component is selenium and wherein a copper-chromium or pure chromium powder is embedded in said pipe.

21. The fusible electrode according to claim 20 where Se in said solid parts comprises up to 2.2% by weight, thus producing a CuCrSe material with a selenium content of up to about 1.1% by weight.

22. The fusible electrode according to claim 3 wherein said further component is antimony and wherein a copper-chromium powder is embedded in said pipe.

23. The fusible electrode according to claim 21 wherein the Sb in said solid part comprises up to 11% by weight, thus producing a CuCrSb material with an antimony content of up to about 5.5% by weight.

24. The fusible electrode according to claim 14 wherein said rods consist of a CuCrTe alloy comprising about 0.4 to about 0.7 weight percent of tellurium.

25. The fusible electrode according to claim 14 wherein said rods consist of a CuTe alloy comprising about 0.4 to about 0.7 weight percent of tellurium.

* * * * *